United States Patent [19]

Horie et al.

[11] Patent Number: 4,630,724

[45] Date of Patent: Dec. 23, 1986

[54] METHOD AND DEVICE FOR FORMING A ROW OF FILTER-TIP CIGARETTES

[75] Inventors: Motonobu Horie; Minoru Suzuki, both of Tokyo; Shinji Ogura, Nagareyama, all of Japan

[73] Assignee: The Japan Tobacco & Salt Public Corporation, Tokyo, Japan

[21] Appl. No.: 705,185

[22] Filed: Feb. 25, 1985

[30] Foreign Application Priority Data

May 2, 1984 [JP] Japan ..... 59-087775

[51] Int. Cl.[4] ..... B65G 47/24

[52] U.S. Cl. ..... 198/399; 198/417; 198/951; 198/450; 131/282

[58] Field of Search ..... 198/399, 404, 951, 452, 198/450, 417; 131/282

[56] References Cited

U.S. PATENT DOCUMENTS

| | | | |
|---|---|---|---|
| 2,929,489 | 3/1960 | Parrish | 131/282 X |
| 3,215,250 | 11/1965 | Schubert | 198/404 X |
| 3,306,423 | 2/1967 | Rowlands | 131/282 X |
| 3,319,764 | 5/1967 | Gamberini | 198/404 X |
| 3,405,579 | 10/1968 | London | 198/450 X |
| 3,625,103 | 12/1971 | Giatti | 198/450 X |
| 3,696,910 | 10/1972 | Schmermund et al. | 198/951 X |
| 3,887,065 | 6/1975 | Verjux | 198/404 |
| 3,973,671 | 8/1976 | Schwenke | 198/404 |
| 4,290,518 | 9/1981 | Dyett et al. | 198/452 X |

FOREIGN PATENT DOCUMENTS

| | | |
|---|---|---|
| A2356215 | 10/1973 | Fed. Rep. of Germany . |
| A2358843 | 2/1978 | France . |
| A2130868 | 6/1984 | United Kingdom . |

*Primary Examiner*—Joseph E. Valenza
*Assistant Examiner*—D. Glenn Dayoan
*Attorney, Agent, or Firm*—Murray and Whisenhunt

[57] ABSTRACT

A method of forming a row of filter-tip cigarettes at a high speed with a simple device. The device for forming a row of filter-tip cigarettes comprises a supply drum having support recesses formed on an outer circumferential portion thereof at equal intervals of a predetermined pitch for receiving two rows of the cigarettes, an inverting drum for receiving the cigarettes from the supply drum and having rotating slots arranged at a pitch equal to that of the support recesses, a roll drum for receiving the cigarettes from the supply drum and having relatively shallow support recesses formed at a patch half the pitch of the support recesses of the supply drum, the roll drum being arranged in parallel relation with the inverting drum, rotation guide members mounted to the inverting drum, a cigarette rolling member provided in opposed relation with the roll drum, and a take-up drum for receiving the cigarettes from the inverting drum and the roll drum, the take-up drum having axially continuous support recesses formed on an outer circumferential portion at a pitch half the pitch of the support recesses of the supply drum.

6 Claims, 3 Drawing Figures

METHOD AND DEVICE FOR FORMING A ROW OF FILTER-TIP CIGARETTES

BACKGROUND OF THE INVENTION

This invention relates to a method and a device for forming a row of filter-tip cigarettes, and more particularly to a method and a device for forming a row of filter-tip cigarettes in a filter-tip cigarette producing machine, wherein one row of the filter-tip cigarettes is inverted to arrange a mount position of filters on the same side relative to the other row of the filter-tip cigarettes.

Generally, a filter-tip cigarette is produced by inserting between two cigarettes a filter member having a length for two cigarettes, winding a piece of paper with paste around a connecting portion of the filter member and the cigarettes to bond the same to the cigarettes, and cutting the filter member at its center to obtain two filter-tip cigarettes.

According to this method, two parallel rows of the filter-tip cigarettes with the filter attached on opposite sides are obtained, and therefore the two rows of the cigarettes are commonly arranged in a single row to meet the requirement for a subsequent work in a packaging or storing apparatus for example by inverting one row of the cigarettes and joining the same with the other row.

In the prior art, a supply drum having support recesses formed on an outer circumferential portion thereof at equal pitch for receiving two rows of the cigarettes is provided, and a row arrangement drum having an odd number of support recesses arranged at a pitch half the pitch of the support recesses of the supply drum is arranged with respect to the supply drum. In the row arrangement drum, one row of the cigarettes as fed from the supply drum is formed as a remaining row and the other is formed as an inversion row. Then, the cigarettes in the inversion row are outwardly rotated about an end portion of the cigarettes in the remaining row as a fulcrum to a position at a right angle to an axis of the row arrangement drum, and are subsequently inverted by an angle of 180° to be joined with the remaining row, thus obtaining a single row of the cigarettes with the filters arranged on the same side.

However, in the prior art device as mentioned above, a center of gravity of the cigarettes is outwardly moved during inversion to increase a centrifugal force, and as a result, the cigarettes tend to escape out of the drum and to be hindered in smooth inverting motion. Recently, such a tendency as above has been remarkably increased with increase in operational speed of the cigarette producing machine.

SUMMARY OF THE INVENTION

It is an object, of the present invention to provide a method of securely forming a row of filter-tip cigarettes at a high speed.

It is another object of the present invention to provide a device for securely forming a row of filter-tip cigarettes at a high speed.

According to one aspect of the present invention, there is provided a method of forming a row of filter-tip cigarettes comprising the steps of axially inverting the cigarettes in one row about a center of gravity of the cigarettes of two rows of the cigarettes having filters attached thereto in opposed direction and arranged in axial alignment to each other, moving the cigarettes in the other row forwardly with respect to a flow direction of the cigarettes to form two zigzag rows of the cigarettes where the filters are attached to the cigarettes in the same direction and the two rows of the cigarettes are arranged out of axial alignment to each other, and moving the cigarettes in the two zigzag rows in an axial direction to form one row of the cigarettes.

According to another aspect of the present invention, there is provided a device for forming a row of filter-tip cigarettes comprising a supply drum having support recesses formed on an outer circumferential portion thereof at equal intervals of a predetermined pitch for receiving two rows of the cigarettes, an inverting drum for receiving the cigarettes from the supply drum and having rotating slots arranged at a pitch equal to that of the support recesses, a roll drum for receiving the cigarettes from the supply drum and having relatively shallow support recesses formed at a pitch half the pitch of the support recesses of the supply drum, the roll drum being arranged in parallel relation with the inverting drum, a rotation guide member mounted to the inverting drum, a cigarette rolling member provided in opposed relation with the roll drum, and a take-up drum for receiving the cigarettes from the inverting drum and the roll drum, the take-up drum having axially continues support recesses formed on an outer circumferential portion at a pitch half the pitch of the support recesses of the supply drum.

These and other objects and features of the present invention will be apparent from the following detailed description and appended claims when taken with the accompanying drawings.

DETAILED DESCRIPTION OF THE PREFERRED EMBODIMENT

In a cigarette producing machine, first a rod-like cigarette of double length with a filter member inserted at a central portion thereof is produced, and then it is cut at a center thereof to form two cigarettes with each direction opposed. These cigarettes are conveyed in two rows to a subsequent working section in a direction perpendicular to a longitudinal direction of each cigarette. On the way of conveyance, one row of the cigarettes is inverted to be arranged in the same direction as of the other row. Then, the two rows of the cigarettes are joined with each other to be arranged in a row.

Figure 1:
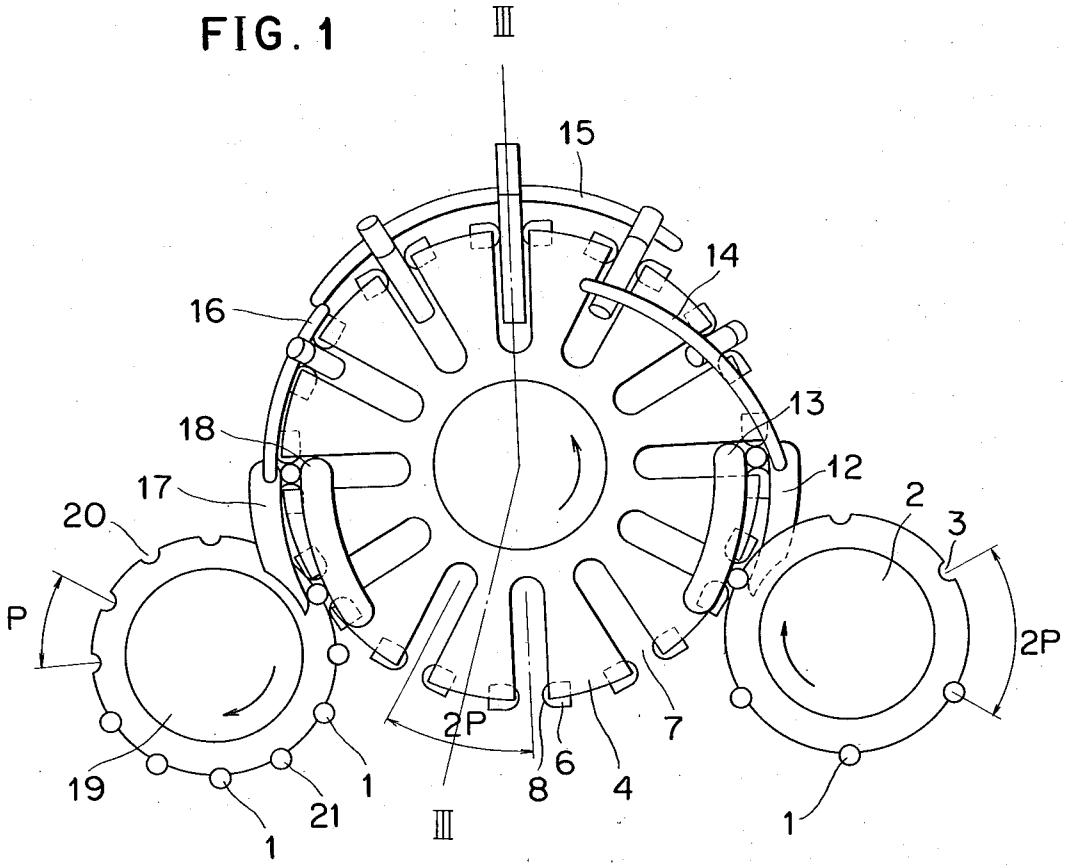
FIG. 1 is a side view of an inverting drum and associated parts according to the present invention.

Referring to FIG. 1, there is shown, in association with the cigarettes, a device required for inverting one row of the cigarettes in the above-mentioned step. The cigarettes 1 are placed in support recesses 3 formed on a circumference of a supply drum 2 at equal intervals of a pitch 2P, and are fed to an inverting drum 4. The support recesses 3 are moved synchronously with slots 7 of the inverting drum 4, and the cigarettes 1 are transferred at a receiving position from the supply drum 2 to the inverting drum 4.

The slots 7 of the inverting drum 4 are arranged in parallel relation with each other in a direction of a rotary axis of the drum 4 at equal intervals of a pitch 2P. The slots 7 have a width slightly larger than a diameter of the cigarettes 1 and a sufficient depth such that the cigarettes 1 may be rotated with the same held by center support members 6 which will be hereinafter described.

Each of the center support members 6 is mounted at an outer end portion of each of the slots 7 in such a manner as to be opposed with a spacing defined therebetween. Such opposed surfaces of the center support members 6 are formed to be spherical surfaces 8 so that the cigarettes 1 may smoothly get in and out of the center support members 6 and may be suitably rotated about the center support members 6 as a fulcrum. The spacing between the opposed spherical surfaces 8 is slightly smaller than a diameter of the cigarettes 1 so as for the cigarettes 1 to be held therein. In addition, the center support members 6 as mounted at the slots 7 are arranged on a circumference of the drum 4.

There are provided at a cigarette receiving portion inlet guide members 12 and 13 which are arranged in opposed relation with each other with a cigarette guide spacing defined therebetween, extending in a substantially circumferential direction of the inverting drum 4. The inlet guide members 12 and 13 serve to disengage the cigarettes 1 from the support recesses 3 and guide the cigarettes into the slots 7. At the final ends of the members 12 and 13, the cigarettes 1 are held such that a diametrical portion of the cigarettes 1 coincides with the narrowest portion between the opposed spherical surfaces 8 of the support members 6. The spherical surfaces 8 are provided with suction holes at foremost ends thereof.

There are provided near a periphery of the inverting drum 4 rotation guide members 14, 15 and 16 in a rotating range of the cigarettes 1. The rotation guide member 14 as shown in FIG. 1 acts to push down an end of the cigarettes 1, while the rotation guide member 15 acts to push up the other end. Accordingly, owing to cooperation of both the guide members 14 and 15, the cigarettes 1 are set upright. Subsequently, the cigarettes 1 are pushed down in the rotational direction by the guide member 15, and are sequentially urged downwardly to a horizontal position by the rotation guide member16. The cigarettes 1 as inverted in this way are taken out of the inverting dum 4 at outlet portion. The outlet portion is provided with an outlet guide members 17 and 18 for guiding to disengage the cigarettes 1 as held by the support members 6 from the support portion and fit the same in every other one of support recesses 20 formed on an outer circumference of a take-up drum 19 at equal intervals of a pitch P.

Figure 2:
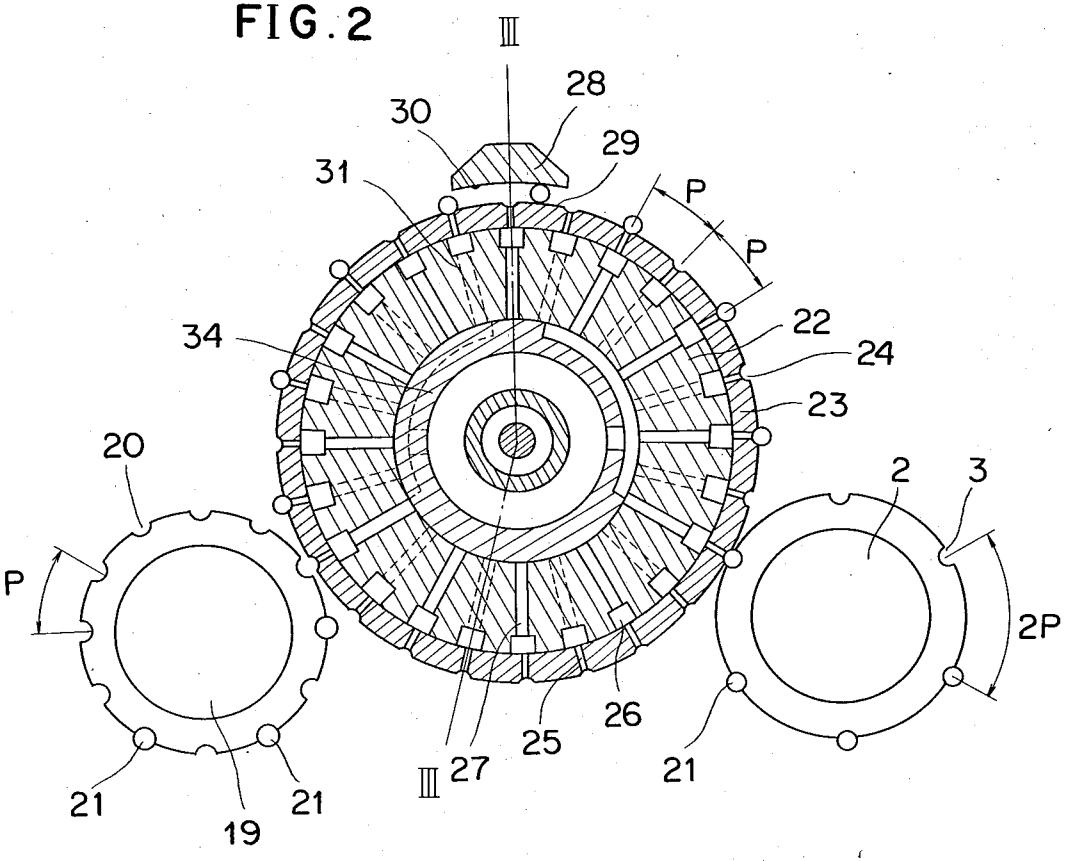
FIG. 2 is a side view of a roll drum and associated parts according to the present invention, the roll drum being shown in cross section taken along a surface including a center of a communication hole.

Referring next to FIG. 2, there is shown, in association with the cigarettes, a device required for forwardly rolling the cigarettes in the other row as employed in the step of the invention.

The cigarettes 21 are placed in the support recesses 3 formed on a circumference of the supply drum 3 at equal intervals of the pitch 2P, and are subsequently fed to a roll drum 22. The roll drum 22 is fixedly provided with a ring 23 on an outer circumference thereof, and is rotated integrally with the ring 23. The ring 23 is formed with relatively shallow support recesses 24 on a circumference thereof at equal intervals of the pitch P. The cigarettes 21 are transferred at a receiving position from the drum 2 to the support recesses 24 every other recess.

The ring 23 is further formed with suction holes 25 communicating with channels 26 in the drum 22. Communication holes 27 are communicated with every other channel 26. In this connection, suction air is applied from a sleeve 34 to the suction hole 25 to hold the cigarettes 21 in the support recesses 24 and convey the same to a rolling plate 28. Then, the cigarettes 21 are forwardly rolled out of the support recesses 24, and are sequentially rolled forwardly as being interposed between a surface 29 of the ring 23 and a surface 30 of the rolling plate 28, then entering the subsequent support recess 24, which is communicated with a communication hole 31. Owing to action of the suction air, the cigarettes 21 are held in the support recesses 24 to be conveyed to the take-up drum 19, where the cigarettes 21 are received in every other one of the support recesses 20 formed on the outer circumference of the take-up drum 19 at equal intervals of the pitch P.

The cigarettes 1 as inverted by the inverting drum 4 and the cigarettes 21 as forwardly rolled by the roll drum 22 are alternately received in the support recesses 20 formed on the outer surface of the take-up drum 19 at equal intervals of the pitch P, and are zigzag arranged in two rows. Then, the cigarettes 1 and/or 21 are moved in a longitudinal direction thereof on the take-up drum 19 by a known method such as air pressure, so as to form a single row of the cigarettes at equal intervals of the pitch P to convey the row of the cigarettes to the subsequent step.

Figure 3:
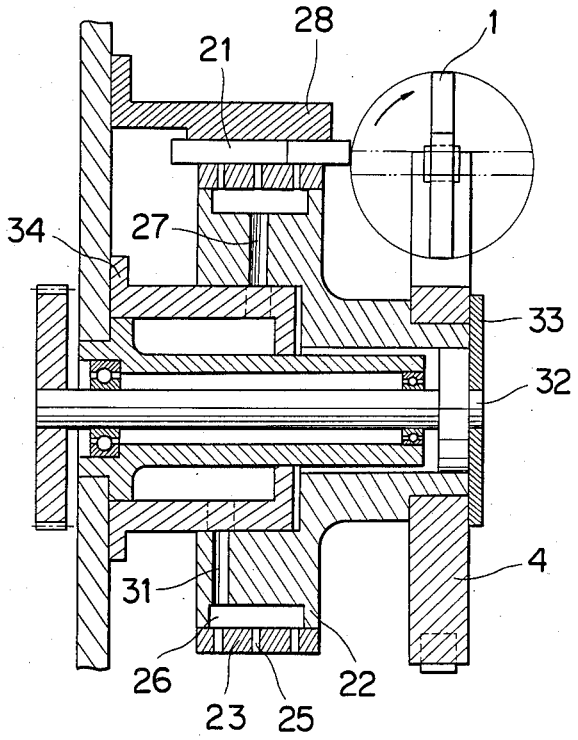
FIG. 3 is a cross section taken along the line III—III in FIGS. 1 and 2.

Referring to FIG. 3 which shows a cross section taken along the line III—III in FIGS. 1 and 2, it will be appreciated that the inverting drum 4 is arranged coaxially with the roll drum 22, and is fixed thereto by a disc 33 so as to rotate integrally therewith about a shaft 32. The roll drum 22 is loosely fitted on a sleeve 34 so that suction air may be supplied through the inside of the sleeve 34 to the support recesses 24 for holding the cigarettes 21.

Although a specific embodiment of the invention has been described, it will be appreciated that the invention is susceptible to modification, variation and change without departing from its proper scope as exemplified by the following claims.

What is claimed is:

1. A method of forming a row of filter-tip cigarettes, said method comprising the steps of:

feeding a plurality of filter-tip cigarettes in two rows, cigarettes in each row having filters attached thereto extending in opposite direction, the cigarettes in one row being arranged in axial alignment with respect to the cigarettes in the other row;

providing a center support means for supporting cigarettes substantially about their centers of gravity;

supporting cigarettes in one of said rows substantially at their centers of gravity by said center support means, so that each cigarette so supported is rotatable about its center of gravity with respect to its respective center support means;

rotating said cigarettes supported by said center support means about their respective centers of gravity to invert said cigarettes;

moving the cigarettes in the other row forwardly with respect to a flow direction of said cigarettes to form two zig zag rows of said cigarettes, where said filters are attached to said cigarettes in the same direction and said two rows of said cigarettes are arranged out of axial alignment with respect to each other; and moving said cigarettes in said two zig zag rows in an axial direction to form one row of said cigarettes.

2. A device for forming a row of filter-tip cigarettes, said device comprising:

a supply drum having support recesses formed at equal intervals of a predetermined pitch for receiving two rows of cigarettes;

an inverting drum for receiving cigarettes from said supply drum and having rotating slots arranged at a pitch equal to said predetermined pitch of said support recesses;

center support means mounted at an outer end portion of said rotating slots for supporting a cigarette at substantially its center of gravity such that said cigarette is rotatable about its center of gravity relative to said center support means;

rotation guide means mounted to said inverting drum for rotating cigarettes supported by said center support means about their centers of gravity;

a roll drum for receiving cigarettes from said supply drum and having relatively shallow support recesses formed at a pitch half the pitch of said support recesses of said supply drum, said roll drum being arranged in parallel relation with said inverting drum;

a cigarette rolling member provided in opposed relation to said roll drum; and a take-up drum for receiving said cigarettes from said inverting drum and said roll drum, said take-up drum having axially continuous support recesses formed on an outer circumferential portion at a pitch half the pitch of said support recesses of said supply drum.

3. A device according to claim 2, wherein said center support means include center support members spaced apart with respect to each other by a distance slightly smaller than a cigarette diameter, whereby a cigarette can be supported between said center support members.

4. A device according to claim 3, wherein said center support members are arranged on a circumference of said inverting drum.

5. A device according to claim 2, wherein said rotation guide means include first and second rotation guide members, said first rotation guide member pushing down an end of a cigarette while said second guide member acts to push up the other end of said cigarette as said cigarette moves in a rotational direction.

6. A device according to claim 5, and further including a third rotation guide member, said second guide member pushing said cigarette downwardly in said rotation direction, and said third guide member urging said cigarette downwardly to a horizontal position.

* * * * *